US006113764A

United States Patent [19]

Emch

[11] Patent Number: 6,113,764

[45] Date of Patent: Sep. 5, 2000

[54] PROCESSES FOR COATING A METAL SUBSTRATE WITH AN ELECTRODEPOSITED COATING COMPOSITION AND DRYING THE SAME

[75] Inventor: Donaldson J. Emch, Brighton, Mich.

[73] Assignee: PPG Industries Ohio, Inc., Cleveland, Ohio

[21] Appl. No.: 09/320,483

[22] Filed: May 26, 1999

[51] Int. Cl.[7] ..... C25D 15/00

[52] U.S. Cl. ..... 204/509; 204/507; 204/491

[58] Field of Search ..... 204/509, 507, 204/491; 205/224

[56] References Cited

U.S. PATENT DOCUMENTS

| | | | |
|---|---|---|---|
| Re. 34,730 | 9/1994 | Salatin et al. | 427/407.1 |
| 1,998,615 | 4/1935 | Groven | 91/70 |
| 2,387,516 | 10/1945 | Kaminski | 219/34 |
| 2,876,135 | 3/1959 | Levine | 117/76 |
| 3,151,950 | 10/1964 | Newman et al. | 34/4 |

(List continued on next page.)

FOREIGN PATENT DOCUMENTS

| | | |
|---|---|---|
| 0038127 | 3/1981 | European Pat. Off. . |
| 0148718 | 11/1984 | European Pat. Off. . |
| 19642970 | 4/1997 | Germany . |
| 2091859 | 8/1982 | United Kingdom . |
| WO 98/40170 | 9/1998 | WIPO . |

OTHER PUBLICATIONS

"Infrared Flash Oven" Brochure, BGK Automotive Group no date available.

"Heated Flash Technical Specifications", General Motors NAO Paint General Technical Specifications Document No. 34909 (Jan. 14, 1997).

"Specifications for Heated Flash Off for Water–Borne Basecoat Application", Ford Motor Co. Body and Assembly Operations Sec. 240 (Jan. 15, 1995).

"The Proof Is In The Heating", Industrial Energy Efficiency Centre, U.K., HQ4ID (Apr. 25, 1995).

R. Hampshire "The Use of Radiant Heat Transfer in the Curing of Coatings on Complex Geometrics and Problematic Substrates", Interfinish 1996 World Congress, Birmingham, UK (Sep. 1996).

W. Veenstra et al., "IRK Halogen Infrared Radiators in the Industrial Heating Process", Philips Lighting, Eindhoven, Netherlands No date available.

"Powder Coatings", Blasdel Equipment Infrared Ovens http://blasdelent,com/powder.html (Mar. 12, 1999).

"Gas Infrared Ovens", Thermovation Engineering Inc. http://www.thomasregister.com/olc/thermovation/gas.htm (Mar. 12, 1999).

"Combination Ovens for Curing of Powder Coatings", IUT No date available.

*Primary Examiner*—Kathryn Gorgos
*Assistant Examiner*—Christopher M. Keehan
*Attorney, Agent, or Firm*—Ann Marie Cannoni

[57] ABSTRACT

A process for drying a liquid electrodeposited coating composition applied to a metal substrate is provided. Infrared radiation and warm air are applied simultaneously to the electrodeposited coating composition for a period of at least about 1 minute, the velocity of the air at the surface of the electrodeposited coating composition being less than about 4 meters per second. The temperature of the metal substrate is increased at a rate ranging from about 0.25° C. per second to about 2° C. per second to achieve a peak metal temperature of the substrate ranging from about 35° C. to about 140° C. Infrared radiation and hot air are applied simultaneously to the electrodeposited coating composition for a period of at least about 2 minutes, during which the temperature of the metal substrate is increased at a rate ranging from about 0.2° C. per second to about 1.5° C. per second to achieve a peak metal temperature ranging from about 160° C. to about 215° C., such that a dried electrodeposited coating is formed upon the surface of the metal substrate.

24 Claims, 3 Drawing Sheets

U.S. PATENT DOCUMENTS

| | | | |
|---|---|---|---|
| 3,455,806 | 7/1969 | Spoor et al. | 204/181 |
| 3,749,657 | 7/1973 | Le Bras et al. | 204/181 |
| 3,953,643 | 4/1976 | Cheung et al. | 428/220 |
| 3,953,644 | 4/1976 | Camelon et al. | 428/220 |
| 3,998,716 | 12/1976 | Masar et al. | 204/181 |
| 4,265,936 | 5/1981 | Prohaska, Jr. | 427/140 |
| 4,336,279 | 6/1982 | Metzger | 427/55 |
| 4,390,564 | 6/1983 | Kimble | 427/35 |
| 4,403,003 | 9/1983 | Backhouse | 427/407.1 |
| 4,416,068 | 11/1983 | Nilsson et al. | 34/4 |
| 4,546,553 | 10/1985 | Best | 34/39 |
| 4,594,266 | 6/1986 | Lemaire et al. | 427/55 |
| 4,731,290 | 3/1988 | Chang | 428/335 |
| 4,771,728 | 9/1988 | Bergman, Jr. | 118/642 |
| 4,820,555 | 4/1989 | Kuwajima et al. | 427/407.1 |
| 4,822,685 | 4/1989 | Perez et al. | 428/423.3 |
| 4,891,111 | 1/1990 | McCollum et al. | 204/181.7 |
| 4,894,261 | 1/1990 | Gulbins et al. | 427/379 |
| 4,907,533 | 3/1990 | Nelson et al. | 118/663 |
| 4,908,231 | 3/1990 | Nelson et al. | 427/55 |
| 4,933,056 | 6/1990 | Corrigan et al. | 204/181.7 |
| 4,943,447 | 7/1990 | Nelson et al. | 427/55 |
| 4,971,837 | 11/1990 | Martz et al. | 422/388.2 |
| 4,988,537 | 1/1991 | Tanimoto et al. | 427/46 |
| 5,050,232 | 9/1991 | Bergman et al. | 392/412 |
| 5,075,132 | 12/1991 | Ogasawara | 427/55 |
| 5,137,972 | 8/1992 | Cook | 525/123 |
| 5,196,485 | 3/1993 | McMonigal et al. | 525/327.3 |
| 5,323,485 | 6/1994 | Josefsson et al. | 392/417 |
| 5,335,308 | 8/1994 | Sorensen | 392/412 |
| 5,338,578 | 8/1994 | Leach | 427/470 |
| 5,340,089 | 8/1994 | Heath et al. | 266/87 |
| 5,401,790 | 3/1995 | Poole et al. | 524/199 |
| 5,407,747 | 4/1995 | Sammel et al. | 428/418 |
| 5,425,970 | 6/1995 | Lahrmann et al. | 427/493 |
| 5,427,822 | 6/1995 | Bracciano | 427/424 |
| 5,453,295 | 9/1995 | Sammel et al. | 427/195 |
| 5,486,384 | 1/1996 | Bastian et al. | 427/493 |
| 5,492,731 | 2/1996 | Temple et al. | 427/407.1 |
| 5,551,670 | 9/1996 | Heath et al. | 266/87 |
| 5,556,527 | 9/1996 | Igarashi et al. | 204/488 |
| 5,612,095 | 3/1997 | Brock et al. | 427/407.1 |
| 5,614,271 | 3/1997 | Shibuya et al. | 427/541 |
| 5,635,302 | 6/1997 | Budde et al. | 428/461 |
| 5,654,037 | 8/1997 | Moore et al. | 427/379 |
| 5,698,310 | 12/1997 | Nakamura et al. | 428/328 |
| 5,709,909 | 1/1998 | Leibfarth et al. | 427/407.1 |
| 5,716,678 | 2/1998 | Rockrath et al. | 427/407.1 |
| 5,760,107 | 6/1998 | Valko et al. | 523/404 |
| 5,820,933 | 10/1998 | Carroll | 427/314 |
| 5,820,987 | 10/1998 | Kaufman et al. | 428/413 |
| 5,871,809 | 2/1999 | Liedtke et al. | 427/140 |
| 5,888,592 | 3/1999 | Biallas et al. | 427/542 |
| B1 4,546,553 | 4/1993 | Best | 34/39 |

PROCESSES FOR COATING A METAL SUBSTRATE WITH AN ELECTRODEPOSITED COATING COMPOSITION AND DRYING THE SAME

CROSS-REFERENCE TO RELATED APPLICATIONS

This patent application is related to U.S. patent application Ser. No. 09/32,064 entitled "Multi-Stage Processes for Coating Substrates with Liquid Basecoat and Powder Topcoat"; U.S. patent application Ser. No. 09/320,265 entitled "Multi-Stage Processes for Coating Substrates with Liquid Basecoat and Liquid Topcoat"; U.S. patent application Ser. No. 09/320,484 entitled "Processes for Drying Primer Coating Compositions"; and U.S. patent application Ser. No. 09/320,522 entitled "Processes for Drying Topcoats and Multi-Component Composite Coatings on Metal and Polymeric Substrates", all of Donaldson J. Emch and each filed concurrently with the present application and still pending.

FIELD OF THE INVENTION

The present invention relates to drying of electrodeposited coating compositions for automotive coating applications and, more particularly, to multi-stage processes for drying liquid electrodeposited coating compositions which include a combination of infrared radiation and convection drying.

BACKGROUND OF THE INVENTION

Today's automobile bodies are treated with multiple layers of coatings which not only enhance the appearance of the automobile, but also provide protection from corrosion, chipping, ultraviolet light, acid rain and other environmental conditions which can deteriorate the coating appearance and underlying car body.

The formulations of these coatings can vary widely. However, a major challenge that faces all automotive manufacturers is how to rapidly dry and cure these coatings with minimal capital investment and floor space, which is valued at a premium in manufacturing plants.

Various ideas have been proposed to speed up drying and curing processes for automobile coatings, such as hot air convection drying. While hot air drying is rapid, a skin can form on the surface of the coating which impedes the escape of volatiles from the coating composition and causes pops, bubbles or blisters which ruin the appearance of the dried coating.

Other methods and apparatus for drying and curing a coating applied to an automobile body are disclosed in U.S. Pat. Nos. 4,771,728; 4,907,533; 4,908,231 and 4,943,447, in which the automobile body is heated with radiant heat for a time sufficient to set the coating on Class A surfaces of the body and subsequently cured with heated air.

U.S. Pat. No. 4,416,068 discloses a method and apparatus for accelerating the drying and curing of refinish coatings for automobiles using infrared radiation. Ventilation air used to protect the infrared radiators from solvent vapors is discharged as a laminar flow over the car body. FIG. 15 is a graph of temperature as a function of time showing the preferred high temperature/short drying time curve 122 versus conventional infrared drying (curve 113) and convection drying (curve 114). Such rapid, high temperature drying techniques can be undesirable because a skin can form on the surface of the coating that can cause pops, bubbles or blisters, as discussed above.

U.S. Pat. No. 4,336,279 discloses a process and apparatus for drying automobile coatings using direct radiant energy, a majority of which has a wavelength greater than 5 microns. Heated air is circulated under turbulent conditions against the back sides of the walls of the heating chamber to provide the radiant heat. Then, the heated air is circulated as a generally laminar flow along the inner sides of the walls to maintain the temperature of the walls and remove volatiles from the drying chamber. As discussed at column 7, lines 18–22, air movement is maintained at a minimum in the central portion of the inner chamber in which the automobile body is dried.

A rapid, multi-stage drying process for automobile coatings is needed which inhibits formation of surface defects and discoloration in the coating, particularly for drying electrodeposited coatings.

SUMMARY OF THE INVENTION

The present invention provides a process for drying a liquid electrodeposited coating composition applied to a metal substrate, comprising the steps of: (a) applying infrared radiation and warm air simultaneously to the electrodeposited coating composition for a period of at least about 1 minute, the velocity of the air at the surface of the electrodeposited coating composition being less than about 4 meters per second, the temperature of the metal substrate being increased at a rate ranging from about 0.25° C. per second to about 2° C. per second to achieve a peak metal temperature of the substrate ranging from about 35° C. to about 140° C.; and (b) applying infrared radiation and hot air simultaneously to the electrodeposited coating composition for a period of at least about 2 minutes, the temperature of the metal substrate being increased at a rate ranging from about 0.2° C. per second to about 1.5° C. per second to achieve a peak metal temperature ranging from about 160° C. to about 215° C., such that a dried electrodeposited coating is formed upon the surface of the metal substrate.

Another aspect of the present invention is a process for coating a metal substrate, comprising the steps of: (a) depositing a liquid electrodepositable coating composition on a surface of the metal substrate to form a liquid electrodeposited coating composition thereon; (b) exposing the liquid electrodeposited coating composition to air having a temperature ranging from about 10° C. to about 40° C. for a period of at least about 30 seconds to volatilize at least a portion of volatile material from the liquid electrodeposited coating composition, the velocity of the air at a surface of the liquid electrodeposited coating composition being less than about 4 meters per second; (c) applying infrared radiation and warm air simultaneously to the electrodeposited coating composition for a period of at least about 1 minute, the velocity of the air at the surface of the electrodeposited coating composition being less than about 4 meters per second, the temperature of the metal substrate being increased at a rate ranging from about 0.25° C. per second to about 2° C. per second to achieve a peak metal temperature of the substrate ranging from about 35° C. to about 140° C.; and (d) applying infrared radiation and hot air simultaneously to the electrodeposited coating composition for a period of at least about 2 minutes, the temperature of the metal substrate being increased at a rate ranging from about 0.2° C. per second to about 1.5° C. per second to achieve a peak metal temperature ranging from about 160° C. to about 215° C., such that a dried electrodeposited coating is formed upon the surface of the metal substrate.

BRIEF DESCRIPTION OF THE DRAWINGS

The foregoing summary, as well as the following detailed description of the preferred embodiments, will be better understood when read in conjunction with the appended drawings. In the drawings.

DETAILED DESCRIPTION OF THE PREFERRED EMBODIMENTS

Figure 1:
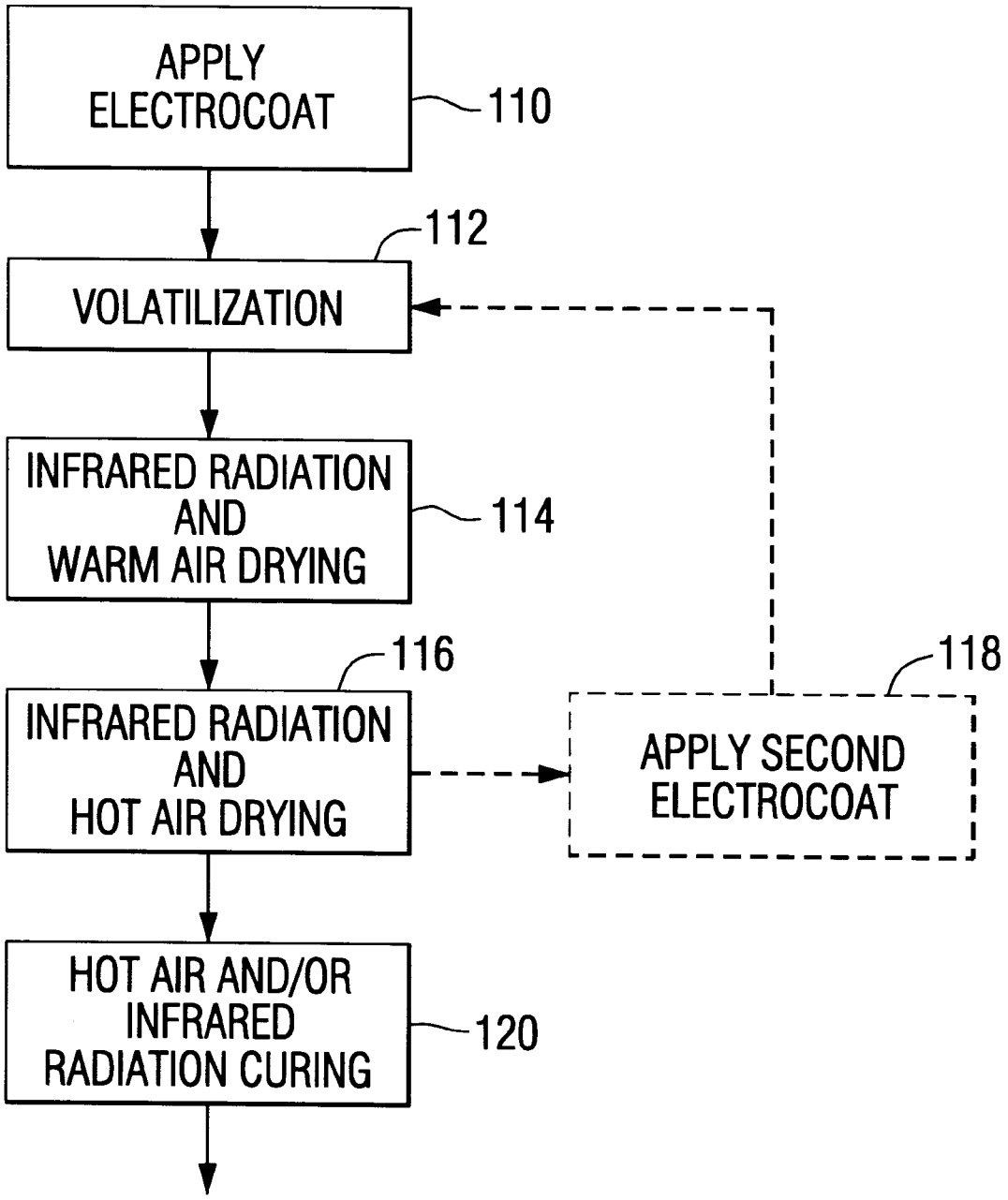
FIG. 1 is a flow diagram of a process for drying an electrodeposited coating composition according to the present invention.

Referring to the drawings, in which like numerals indicate like elements throughout, there is shown in FIG. 1 a flow diagram of a multi-stage process for coating a substrate according to the present invention.

This process is suitable for coating metal substrates in a batch or continuous process. In a batch process, the substrate is stationary during each treatment step of the process, whereas in a continuous process the substrate is in continuous movement along an assembly line. The present invention will now be discussed generally in the context of coating a substrate in a continuous assembly line process, although the process also is useful for coating substrates in a batch process.

Useful metal substrates that can be coated according to the process of the present invention include ferrous metals such as iron, steel, and alloys thereof, non-ferrous metals such as aluminum, zinc, magnesium and alloys thereof, and combinations thereof. Preferably, the substrate is formed from cold rolled steel, electrogalvanized steel such as hot dip electrogalvanized steel or electrogalvanized iron-zinc steel, aluminum or magnesium.

Preferably, the metal substrates are used as components to fabricate automotive vehicles, including but not limited to automobiles, trucks and tractors. The metal substrates can have any shape, but are preferably in the form of automotive body components such as bodies (frames), hoods, doors, fenders, bumpers and/or trim for automotive vehicles.

The present invention first will be discussed generally in the context of coating a metallic automobile body. One skilled in the art would understand that the process of the present invention also is useful for coating non-automotive metal components.

Prior to treatment according to the process of the present invention, the metal substrate can be cleaned and degreased and a pretreatment coating, such as CHEMFOS 700 zinc phosphate or BONAZINC zinc-rich pretreatment (each commercially available from PPG Industries, Inc. of Pittsburgh, Pa.), can be deposited upon the surface of the metal substrate.

Referring now to FIG. 1, which presents a flow chart of the process of the present invention, a liquid electrodepositable coating composition is applied to a surface of the metal substrate (automobile body 16 shown in FIG. 2) in a first step 110, for example by dipping the substrate in a bath containing the liquid electrodepositable coating composition. The liquid electrodepositable coating composition can be applied to the surface of the substrate in step 110 by any suitable anionic or cationic electrodeposition process well known to those skilled in the art. In a cationic electrodeposition process, the liquid electrodepositable coating composition is placed in contact with an electrically conductive anode and an electrically conductive cathode with the metal surface to be coated being the cathode. Following contact with the liquid electrodepositable coating composition, an adherent film of the coating composition is deposited on the cathode when sufficient voltage is impressed between the electrodes. The conditions under which electrodeposition is carried out are, in general, similar to those used in electrodeposition of other coatings. The applied voltages can be varied and can be, for example, as low as 1 volt to as high as several thousand volts, but typically between 50 and 500 volts. The current density is usually between 0.5 and 15 amperes per square foot and tends to decrease during electrodeposition indicating the formation of an insulating film.

Useful electrodepositable coating compositions include anionic or cationic electrodepositable compositions well known to those skilled in the art. Such compositions generally comprise at least one film-forming material and crosslinking material. Suitable film-forming materials include epoxy-functional film-forming materials, polyurethane film-forming materials, and acrylic film-forming materials. The amount of film-forming material in the electrodepositable composition generally ranges from about 50 to about 95 weight percent on a basis of total weight solids of the electrodepositable composition.

Suitable epoxy-functional materials contain at least one epoxy or oxirane group in the molecule, such as di- or polyglycidyl ethers of polyhydric alcohols. Preferably, the epoxy-functional material contains at least two epoxy groups per molecule. Useful polyglycidyl ethers of polyhydric alcohols can be formed by reacting epihalohydrins, such as epichlorohydrin, with polyhydric alcohols, such as dihydric alcohols, in the presence of an alkali condensation and dehydrohalogenation catalyst such as sodium hydroxide or potassium hydroxide. Suitable polyhydric alcohols can be aromatic, aliphatic or cycloaliphatic. Non-limiting examples of suitable aromatic polyhydric alcohols include dihydroxybenzenes, such as resorcinol, pyrocatechol and hydroquinone; bis(4-hydroxyphenyl)-1,1-isobutane; 4,4-dihydroxybenzophenone; bis(4-hydroxyphenyl)-1,1-ethane; bis(2-hydroxyphenyl)methane; 1,5-hydroxynaphthalene; 4-isopropylidene bis(2,6-dibromophenol); 1,1,2,2-tetra(p-hydroxy phenyl)-ethane; 1,1,3-tris(p-hydroxy phenyl)-propane; novolac resins; bisphenol F; long-chain bisphenols; and 2,2-bis(4-hydroxyphenyl)propane, i.e., bisphenol A (preferred). Non-limiting examples of aliphatic polyhydric alcohols include glycols such as ethylene glycol, diethylene glycol, triethylene glycol, 1,2-propylene glycol, 1,4-butylene glycol, 2,3-butylene glycol, pentamethylene glycol, polyoxyalkylene glycol; polyols such as sorbitol, glycerol, 1,2,6-hexanetriol, erythritol and trimethyloipropane; and mixtures thereof. An example of a suitable cycloaliphatic alcohol is cyclohexanedimethanol.

Suitable epoxy-functional materials have an epoxy equivalent weight ranging from about 100 to about 2000, as measured by titration with perchloric acid using methyl violet as an indicator. Useful polyepoxides are disclosed in U.S. Pat. No. 5,820,987 at column 4, line 52 through column 6, line 59, which is incorporated herein by reference. Examples of suitable commercially available epoxy-functional materials are EPON® 828 and 880 epoxy resins, which are epoxy functional polyglycidyl ethers of bisphenol A prepared from bisphenol A and epichlorohydrin and are commercially available from Shell Chemical Company.

The epoxy-functional material can be reacted with amines to form cationic salt groups, such as primary or secondary amines which can be acidified after reaction with the epoxy groups to form amine salt groups or tertiary amines which can be acidified prior to reaction with the epoxy groups and which after reaction with the epoxy groups form quaternary ammonium salt groups. Other useful cationic salt group formers include sulfides.

Suitable acrylic-functional materials include polymers derived from alkyl esters of acrylic acid and methacrylic acid such as are disclosed in U.S. Pat. Nos. 3,455,806 and 3,928,157, which are incorporated herein by reference.

Examples of film-forming resins suitable for anionic electrodeposition include base-solubilized, carboxylic acid-containing polymers such as the reaction product or adduct of a drying oil or semi-drying fatty acid ester with a dicarboxylic acid or anhydride; and the reaction product of a fatty acid ester, unsaturated acid or anhydride and any additional unsaturated modifying materials which are further reacted with polyol. Also suitable are at least partially neutralized interpolymers of hydroxy-alkyl esters of unsaturated carboxylic acids, unsaturated carboxylic acid and at least one other ethylenically unsaturated monomer. Other suitable electrodepositable resins comprise an alkyd-aminoplast vehicle, i.e., a vehicle containing an alkyd resin and an amine-aldehyde resin or mixed esters of a resinous polyol. These compositions are described in detail in U.S. Pat. No. 3,749,657 at column 9, lines 1–75 and column 10, lines 1–13, all of which are herein incorporated by reference. Other acid functional polymers can also be used such as phosphatized polyepoxide or phosphatized acrylic polymers which are well known to those skilled in the art.

Useful crosslinking materials comprise blocked or unblocked polyisocyanates including as aromatic diisocyanates such as p-phenylene diisocyanate, 4,4'-diphenylmethane diisocyanate and 2,4- or 2,6-toluene diisocyanate; aliphatic diisocyanates such as 1,4-tetramethylene diisocyanate and 1,6-hexamethylene diisocyanate; and cycloaliphatic diisocyanates such as isophorone diisocyanate and 4,4'-methylene-bis(cyclohexyl isocyanate). Examples of suitable blocking agents for the polyisocyanates include lower aliphatic alcohols such as methanol, oximes such as methyl ethyl ketoxime and lactams such as caprolactam. The amount of the crosslinking material in the electrodepositable coating composition generally ranges from about 5 to about 50 weight percent on a basis of total resin solids weight of the electrodepositable coating composition.

Generally, the electrodepositable coating composition also comprises one or more pigments which can be incorporated in the form of a paste, surfactants, wetting agents, catalysts, film build additives, flatting agents, defoamers, microgels, pH control additives and volatile materials such as water, organic solvents, as described in U.S. Pat. No. 5,820,987 at column 9, line 13 through column 10, line 27, and low molecular weight acids. Useful solvents included in the composition, in addition to any provided by other coating components, include coalescing solvents such as hydrocarbons, alcohols, esters, ethers and ketones. Preferred coalescing solvents include alcohols, polyols, ethers and ketones. Non-limiting examples of suitable solvents include isopropanol, butanol, 2-ethylhexanol, isophorone, 4-methoxy-2-pentanone, ethylene glycol, propylene glycol and the monoethyl, monobutyl and monohexyl ethers of ethylene glycol. The amount of coalescing solvent is generally about 0.05 to about 5 weight percent on a basis of total weight of the electrodepositable coating composition.

Other useful electrodepositable coating compositions are disclosed in U.S. Pat. Nos. 4,891,111; 5,760,107 and 4,933,056, which are incorporated herein by reference. The solids content of the liquid electrodepositable coating composition generally ranges from about 3 to about 75 weight percent, and preferably about 5 to about 50 weight percent on a basis of total solids of the coating composition.

If the electrodepositable coating composition is applied by immersing the metal substrate into a bath, after removing the substrate from the bath the substrate is exposed to air to permit excess electrodeposited coating composition to drain from the interior cavities and surfaces of the substrate. Preferably, the drainage period is at least 5 minutes, and more preferably about 5 to about 10 minutes so that there is no standing water from the final water rinse. The temperature of the air during the drainage period preferably ranges from about 10° C. to about 40° C. The velocity of the air during drainage is preferably less than about 0.5 meters per second.

The thickness of the electrodepositable coating applied to the substrate can vary based upon such factors as the type of substrate and intended use of the substrate, i.e., the environment in which the substrate is to be placed and the nature of the contacting materials. Generally, the thickness of the electrodepositable coating applied to the substrate ranges from about 5 to about 40 micrometers, and more preferably about 12 to about 35 micrometers.

Referring now to FIG. 1, after applying the electrodepositable coating composition to the surface of the substrate, the process of the present invention optionally can include a second step 12, 112 of exposing the electrodeposited coating composition to low velocity air having a temperature ranging from about 10° C. to about 40° C., and preferably about 20° C. to about 30° C., for a period of at least about 30 seconds to volatilize at least a portion of the volatile material from the liquid electrodeposited coating composition and set the electrodeposited coating. This step can be part of the drainage step discussed above.

As used herein, the term "set" means that the electrodeposited coating is tack-free (resists adherence of dust and other airborne contaminants) and is not disturbed or marred (waved or rippled) by air currents which blow past the electrocoated surface. The velocity of the air at a surface of the electrodeposited coating is less than about 0.5 meters per second and preferably ranges from about 0.3 to about 0.5 meters per second.

Figure 2:
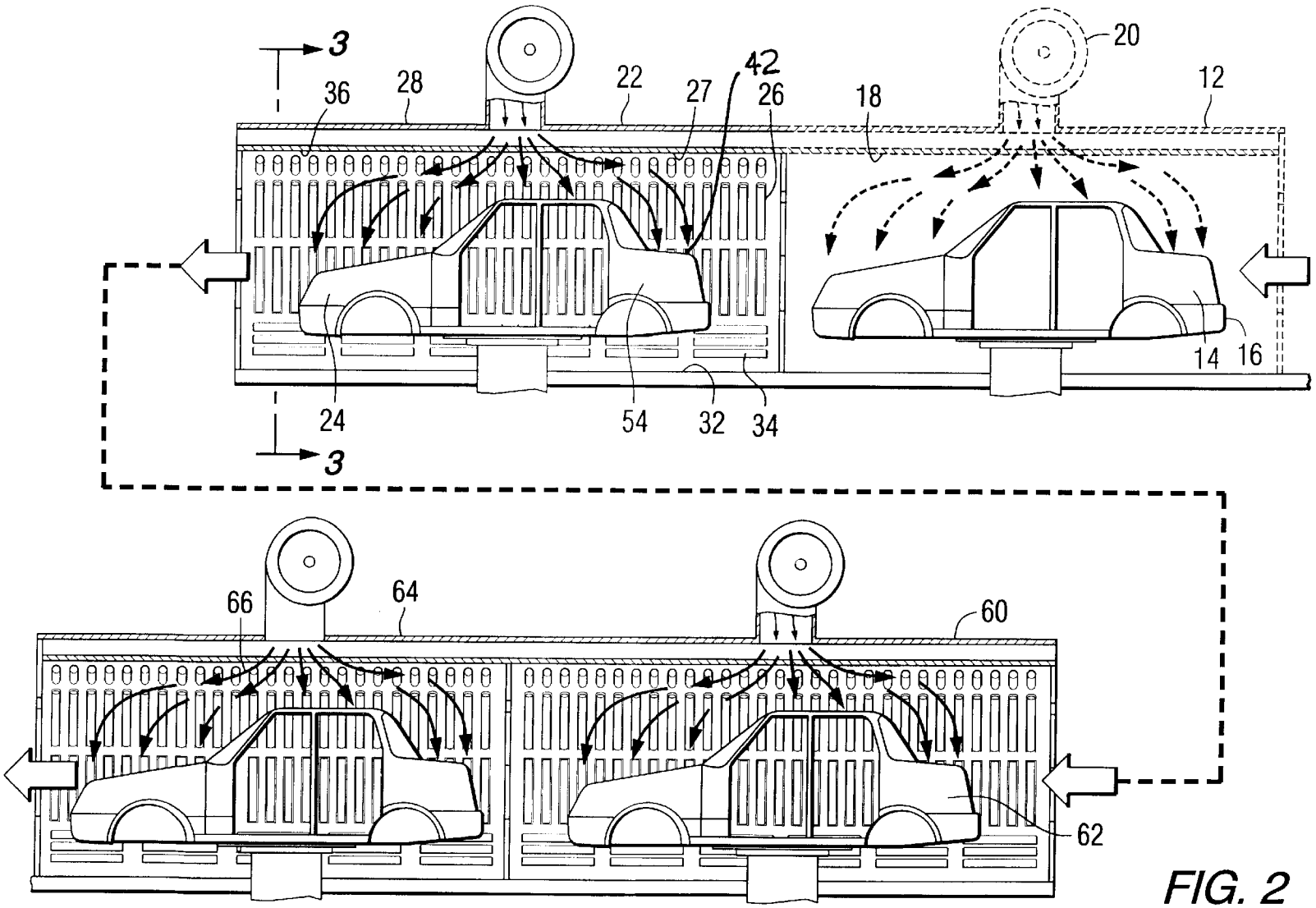
FIG. 2 is a side elevational schematic diagram of a portion of the process of FIG. 1.

The draining and volatilization of the electrodeposited coating 14 from the surface of the automobile body 16 can be carried out in the open air, but is preferably carried out in a first drying chamber 18 in which air is circulated at low velocity to minimize airborne particle contamination as shown in FIG. 2. The automobile body 16 is positioned at the entrance to the first drying chamber 18 and slowly moved therethrough in assembly-line manner at a rate which permits the drainage and, if desired, volatilization of the electrodeposited coating as discussed above. The rate at which the automobile body 16 is moved through the first drying chamber 18 and the other drying chambers discussed below depends in part upon the length and configuration of the drying chamber 18, but preferably ranges from about 3 meters per minute to about 10 meters per minute for a continuous process. One skilled in the art would understand that individual dryers can be used for each step of the process or that a single dryer having a plurality of individual drying chambers or sections (shown in FIG. 2) configured to correspond to each step of the process can be used, as desired.

The air preferably is supplied to the first drying chamber 18 by a blower 20 or dryer, shown in phantom in FIG. 2. A non-limiting example of a suitable blower is an ALTIVAR 66 blower which is commercially available from Square D Corporation. The air can be circulated at ambient temperature or heated, if necessary, to the desired temperature range of about 10° C. to about 40° C. Preferably, the substrate having the electrodeposited coating thereon is exposed to air for a period ranging from about 5 to about 10 minutes so that there is no standing water on the substrate surfaces before the automobile body 16 is moved to the next stage of the drying process. Draining the electrodeposited coating from the substrate and volatilizing any volatile components induces flow and removes volatile components which can form imperfections in the heating steps to follow.

Referring now to FIGS. 1 and 2, the process comprises a next step 22, 114 of applying infrared radiation and low velocity warm air simultaneously to the electrodeposited coating for a period of at least about 1 minute (preferably about 1 to about 3 minutes) such that the temperature of the metal substrate is increased at a rate ranging from about 0.25° C. per second to about 2° C. (preferably about 0.8° C. to about 1.2° C.) per second to achieve a peak metal temperature ranging from about 35° C. to about 140° C. and form a pre-dried electrodeposited coating upon the surface of the metal substrate. By controlling the rate at which the metal temperature is increased and peak metal temperature, flaws in the appearance of the electrocoat and subsequently applied basecoat and topcoat, such as pops and bubbles, can be minimized.

The infrared radiation applied preferably includes near-infrared region (0.7 to 1.5 micrometers) and intermediate-infrared region (1.5 to 20 micrometers) radiation, and more preferably ranges from about 0.7 to about 4 micrometers. The infrared radiation heats the Class A (external) surfaces 24 of the coated substrate which are exposed to the radiation and preferably does not induce chemical reaction or crosslinking of the components of the electrodeposited coating. Most non-Class A surfaces are not exposed directly to the infrared radiation but will be heated through conduction through the automobile body and random scattering of the infrared radiation.

Figure 3:
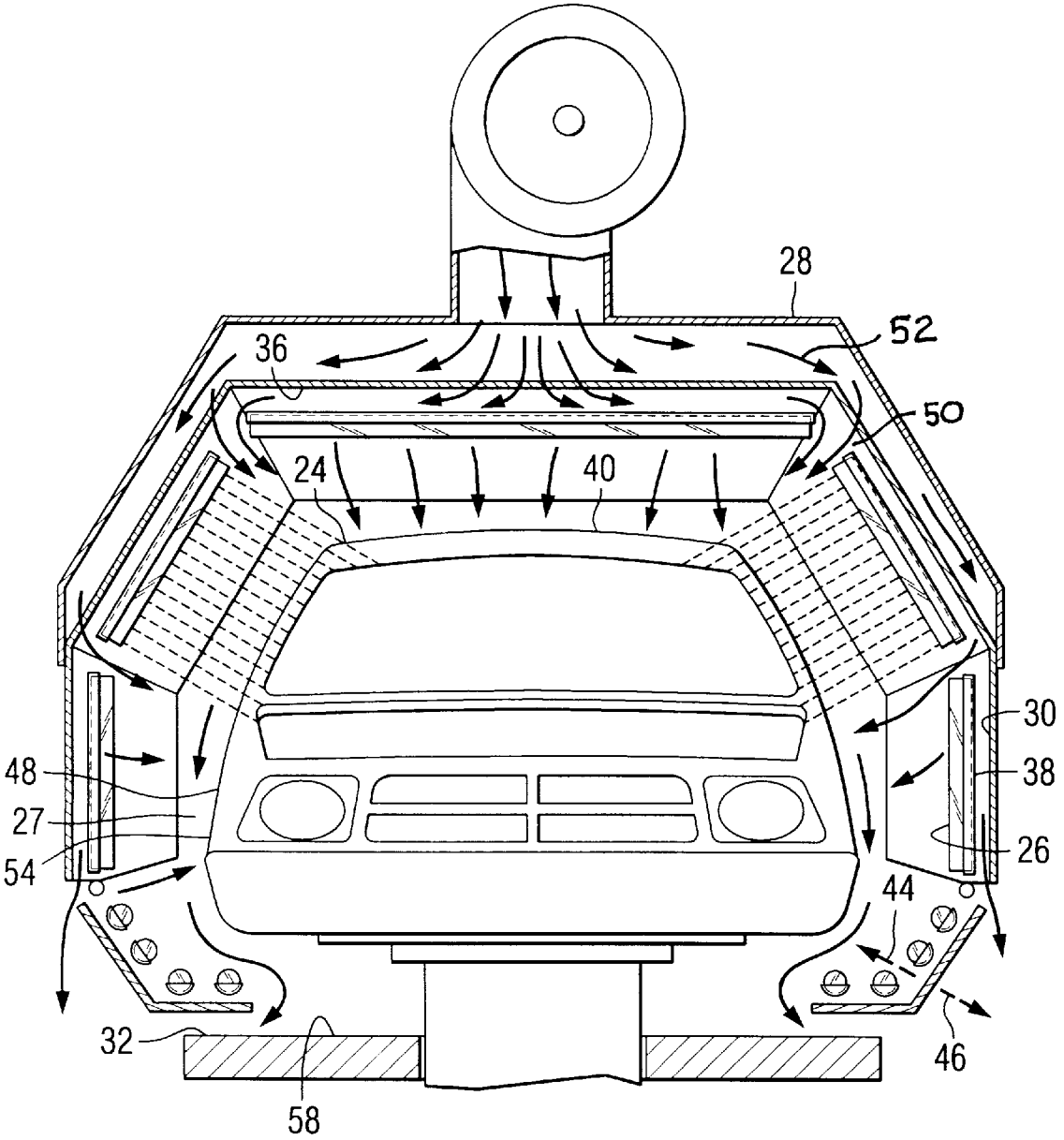
FIG. 3 is a front elevational view taken along line 3—3 of a portion of the schematic diagram of FIG. 2.

Referring now to FIGS. 2 and 3, the infrared radiation is emitted by a plurality of emitters 26 arranged in the interior drying chamber 27 of a combination infrared/convection drying apparatus 28. Each emitter 26 is preferably a high intensity infrared lamp, preferably a quartz envelope lamp having a tungsten filament. Useful short wavelength (0.76 to 2 micrometers), high intensity lamps include Model No. T-3 lamps such as are commercially available from General Electric Co., Sylvania, Phillips, Heraeus and Ushio and have an emission rate of between 75 and 100 watts per lineal inch at the light source. Medium wavelength (2 to 4 micrometers) lamps also can be used and are available from the same suppliers. The emitter lamp is preferably generally rod-shaped and has a length that can be varied to suit the configuration of the oven, but generally is preferably about 0.75 to about 1.5 meters long. Preferably, the emitter lamps on the side walls 30 of the interior drying chamber 27 are arranged generally vertically with reference to ground 32, except for a few rows 34 (preferably about 3 to about 5 rows) of emitters 26 at the bottom of the interior drying chamber 27 which are arranged generally horizontally to ground 32.

The number of emitters 26 can vary depending upon the desired intensity of energy to be emitted. In a preferred embodiment, the number of emitters 26 mounted to the ceiling 36 of the interior drying chamber 27 is about 24 to about 32 arranged in a linear side-by side array with the emitters 26 spaced about 10 to about 20 centimeters apart from center to center, and preferably about 15 centimeters. The width of the interior drying chamber 27 is sufficient to accommodate the automobile body or whatever substrate component is to be dried therein, and preferably is about 2.5 to about 3.0 meters wide. Preferably, each side wall 30 of the chamber 27 has about 50 to about 60 lamps with the lamps spaced about 15 to about 20 centimeters apart from center to center. The length of each side wall 30 is sufficient to encompass the length of the automobile body or whatever substrate component is being dried therein, and preferably is about 4 to about 6 meters. The side wall 30 preferably has four horizontal sections which are angled to conform to the shape of the sides of the automobile body. The top section of the side wall 30 preferably has 24 parallel lamps divided into 6 zones. The three zones nearest the entrance to the drying chamber 27 are operated at medium wavelengths, the three nearest the exit at short wavelengths. The middle section of the side wall is configured similarly to the top section. The two lower sections of the side walls each preferably contain 6 bulbs in a 2 by 3 array. The first section of bulbs nearest the entrance is preferably operated at medium wavelength and the other two sections at short wavelengths.

Referring to FIG. 2, each of the emitter lamps 26 is disposed within a trough-shaped reflector 38 that is preferably formed from polished aluminum. Suitable reflectors include aluminum or integral gold-sheathed reflectors which are commercially available from BGK-ITW Automotive, Heraeus and Fannon Products. The reflectors 38 gather energy transmitted from the emitter lamps 26 and focus the energy on the automobile body 16 to lessen energy scattering.

Depending upon such factors as the configuration and positioning of the automobile body 16 within the interior drying chamber 27 and the color of the basecoat to be dried, the emitter lamps 26 can be independently controlled by microprocessor (not shown) such that the emitter lamps 26 furthest from a Class A surface 24 can be illuminated at a greater intensity than lamps closest to a Class A surface 24 to provide uniform heating. For example, as the roof 40 of the automobile body 16 passes beneath a section of emitter lamps 26, the emitter lamps 26 in that zone can be adjusted to a lower intensity until the roof 40 has passed, then the intensity can be increased to heat the deck lid 42 which is at a greater distance from the emitter lamps 26 than the roof 40.

Also, in order to minimize the distance from the emitter lamps 26 to the Class A surfaces 24, the position of the side walls 30 and emitter lamps 26 can be adjusted toward or away from the automobile body as indicated by directional arrows 44, 46, respectively, in FIG. 3. One skilled in the art would understand that the closer the emitter lamps 26 are to the Class A surfaces 24 of the automobile body 16, the greater the percentage of available energy which is applied to heat the surfaces 24 and coatings present thereon. Generally, the infrared radiation is emitted at a power density ranging from about 10 to about 25 kilowatts per square meter ($kW/m^2$) of emitter wall surface, and preferably about 12 $kW/m^2$ for emitter lamps 26 facing the sides 48 of the automobile body 16 (doors or fenders) which are closer than the emitter lamps 26 facing the hood and deck lid 42 of the automobile body 16, which preferably emit about 24 $kW/m^2$.

A non-limiting example of a suitable combination infrared/convection drying apparatus is a BGK combined infrared radiation and heated air convection oven, which is commercially available from BGK Automotive Group of Minneapolis, Minn. The general configuration of this oven will be described below and is disclosed in U.S. Pat. Nos.

4,771,728; 4,907,533; 4,908,231 and 4,943,447, which are hereby incorporated by reference. Other useful combination infrared/convection drying apparatus are commercially available from Durr of Wixom, Mich.; Thermal Innovations of Manasquan, N.J.; Thermovation Engineering of Cleveland, Ohio; Dry-Quick of Greenburg, Ind. and Wisconsin Oven and Infrared Systems of East Troy, Wis.

Referring now to FIGS. 2 and 3, the preferred combination infrared/convection drying apparatus 28 includes baffled side walls 30 having nozzles or slot openings 50 through which air 52 is passed to enter the interior drying chamber 27 at a velocity of less than about 4 meters per second. During this step 114, the velocity of the air at the surface 54 of the electrodeposited coating is less than about 4 meters per second, preferably ranges from about 0.5 to about 4 meters per second and, more preferably, about 0.7 to about 1.5 meters per second.

The temperature of the air 52 generally ranges from about 35° C. to about 125° C., and preferably about 70° C. to about 110° C. The air 52 is supplied by a blower 56 or dryer and can be preheated externally or by passing the air over the heated infrared emitter lamps 26 and their reflectors 38. By passing the air 52 over the emitters 26 and reflectors 38, the working temperature of these parts can be decreased, thereby extending their useful life. Also, undesirable solvent vapors can be removed from the interior drying chamber 27. The air 52 can also be circulated up through the interior drying chamber 27 via the subfloor 58. Preferably, the air flow is recirculated to increase efficiency. A portion of the air flow can be bled off to remove contaminants and supplemented with filtered fresh air to make up for any losses.

The automobile body 16 is heated by the infrared radiation and warm air to a peak metal temperature ranging from about 35° C. to about 140° C., and preferably about 70° C. to about 95° C. As used herein, "peak metal temperature" means the target instantaneous temperature to which the metal substrate (automobile body 16) must be heated measured at the surface of the coated substrate approximately in the middle of the side of the substrate opposite the side on which the coating is applied. It is preferred that this peak metal temperature be maintained for as short a time as possible to minimize the possibility of crosslinking of the electrodeposited coating.

Referring now to FIGS. 1 and 2, the process of the present invention comprises a next step 60, 116 of applying infrared radiation and hot air simultaneously to the electrodeposited coating on the metal substrate (automobile body 16) for a period of at least about 2 minutes (preferably about 2 to about 3 minutes). The temperature of the metal substrate is increased at a rate ranging from about 0.2° C. per second to about 1.5° C. per second to achieve a peak metal temperature of the substrate ranging from about 160° C. to about 215° C. A dried electrocoat 62 is formed thereby upon the surface of the metal substrate.

This drying step 116 can be carried out in a similar manner to that of step 114 above using a combination infrared radiation/convection drying apparatus, however the rate at which the temperature of the metal substrate is increased ranges from about 0.2° C. per second to about 1.5° C. per second and peak metal temperature of the substrate ranges from about 160° C. to about 215° C. Preferably, the heating rate ranges from about 0.25° C. per second to about 1.1° C. per second and the peak metal temperature of the substrate ranges from about 190° C. to about 205° C.

The infrared radiation applied preferably includes near-infrared region (0.7 to 1.5 micrometers) and intermediate-infrared region (1.5 to 20 micrometers) radiation, and more preferably ranges from about 0.7 to about 4 micrometers.

The hot drying air preferably has a temperature ranging from about 120° C. to about 180° C., and more preferably about 135° C. to about 150° C. The velocity of the air at the surface of the electrodeposited coating in drying step 116 is preferably less than about 6 meters per second, and preferably ranges from about 1 to about 4 meters per second.

Drying step 116 can be carried out using any conventional combination infrared/convection drying apparatus such as the BGK combined infrared radiation and heated air convection oven which is described in detail above. The individual emitters 26 can be configured as discussed above and controlled individually or in groups by a microprocessor (not shown) to provide the desired heating and infrared energy transmission rates.

The process of the present invention can further comprise an additional step 118 of applying a second electrodepositable coating upon the surface of the dried electrocoat. The second electrodepositable coating can be applied in a manner similar to that discussed above for depositing the first electrodepositable coating.

The second electrodepositable coating can be the same or different from the first electrodepositable coating. For example, the individual components of the second electrodepositable coating, such as film-forming material, can vary or the amounts of each component can vary, as desired. Suitable components for the second electrodepositable coating include those discussed above as suitable for the first electrodepositable coating. Preferably, the first electrodepositable coating comprises an epoxy-functional film-forming material and polyisocyanate crosslinking material to provide corrosion resistance and the second electrodepositable coating comprises an acrylic film-forming material and polyisocyanate crosslinking material to provide chip resistance from impacts by stones and road debris as well as resistance to ultraviolet light that can cause photodegradation and loss of adhesion of the coating to the substrate.

The second electrocoat, if present, can be dried by conventional hot air convection drying or infrared drying, but preferably is dried by exposing the second electrodeposited coating composition to low velocity air to volatilize at least a portion of the volatile material from the liquid second electrodeposited coating composition and set the coating. The processing conditions for this step are similar to those described for step 112 above. After volatilization, infrared radiation and low velocity warm air is applied simultaneously to the second electrodeposited coating under conditions similar to those described above for step 114 to form a pre-dried electrodeposited coating upon the surface of the metal substrate. Next, infrared radiation and hot air are applied simultaneously to the pre-dried second electrodeposited coating under conditions similar to those described above for step 116 to form a dried electrocoat upon the surface of the metal substrate.

The dried electrocoat(s) that are formed upon the surface of the automobile body 16 are dried sufficiently to enable application of a basecoat such that the quality of the basecoat will not be affected adversely by further drying of the electrocoat(s). Preferably, the dried electrocoat(s) are cured prior to application of the basecoat. To cure the dried electrocoat(s), the process of the present invention can further comprise an additional curing step 64, 120 in which hot air 66 is applied to the dried electrocoat(s) for a period of at least about 6 minutes after step 116 or step 118 to achieve a peak metal temperature ranging from about 160°

C. to about 215° C. and cure the electrocoat(s). Preferably, a combination of hot air convection drying and infrared radiation is used simultaneously to cure the dried electrocoat (s). As used herein, "cure" means that any crosslinkable components of the dried electrocoat(s) are substantially crosslinked.

This curing step 120 can be carried out using a hot air convection oven, such as an automotive radiant wall/convection oven which is commercially available from Durr, Haden or Thermal Engineering Corp. or in a similar manner to that of step 114 above using a combination infrared radiation/convection drying apparatus, however the peak metal temperature of the substrate ranges from about 160° C. to about 215° C. and the substrate is maintained at the peak metal temperature for at least about 6 minutes, and preferably about 6 to about 15 minutes.

The hot drying air preferably has a temperature ranging from about 140° C. to about 220° C., and more preferably about 180° C. to about 215° C. The velocity of the air at the surface of the electrocoating composition in curing step 120 can range from about 4 to about 20 meters per second, and preferably ranges from about 10 to about 20 meters per second.

If a combination of hot air and infrared radiation is used, the infrared radiation applied preferably includes near-infrared region (0.7 to 1.5 micrometers) and intermediate-infrared region (1.5 to 20 micrometers), and more preferably ranges from about 0.7 to about 4 micrometers. Curing step 120 can be carried out using any conventional combination infrared/convection drying apparatus such as the BGK combined infrared radiation and heated air convection oven which is described in detail above.

The individual emitters 26 can be configured as discussed above and controlled individually or in groups by a microprocessor (not shown) to provide the desired heating and infrared energy transmission rates.

For any of the above drying/curing steps for the second electrocoating, the assembly line can be configured to permit the automobile body 16 having the second electrocoating thereon to be dried in one or more of the same ovens as those used for drying the first electrocoating to decrease energy consumption.

The process of the present invention can further comprise a cooling step in which the temperature of the automobile body 16 having the dried and/or cured electrocoat thereon from steps 116, 118 and/or 120 is cooled, preferably to a temperature ranging from about 20° C. to about 60° C. and, more preferably, about 25° C. to about 30° C. Cooling the electrocoated automobile body 16 can facilitate application of the next coating of liquid basecoat thereon by preventing a rapid flash of the liquid basecoat volatiles which can cause poor flow, rough surfaces and generally poor appearance. The electrocoated automobile body 16 can be cooled in air at a temperature ranging from about 15° C. to about 35° C., and preferably about 25° C. to about 30° C., for a period ranging from about 15 to about 45 minutes. Alternatively or additionally, the electrocoated automobile body 16 can be cooled by exposure to chilled, saturated air blown onto the surface of the substrate at about 4 to about 10 meters per second.

The process of the present invention can further comprise an additional step of applying a liquid primer or basecoating composition upon the surface of the dried electrocoat. The liquid basecoating can be applied to the surface of the substrate by any suitable coating process well known to those skilled in the art, for example by dip coating, direct roll coating, reverse roll coating, curtain coating, spray coating, brush coating and combinations thereof. The method and apparatus for applying the liquid basecoating composition to the substrate is determined in part by the configuration and type of substrate material.

The liquid basecoating composition comprises a film-forming material or binder, volatile material and optionally pigment. Preferably, the basecoating composition is a crosslinkable coating composition comprising at least one thermosettable film-forming material, such as acrylics, polyesters (including alkyds), polyurethanes and epoxies, and at least one crosslinking material. Thermoplastic film-forming materials such as polyolefins also can be used. The amount of film-forming material in the liquid basecoat generally ranges from about 40 to about 97 weight percent on a basis of total solids of the basecoating composition.

Suitable acrylic polymers include copolymers of one or more of acrylic acid, methacrylic acid and alkyl esters thereof, such as methyl methacrylate, ethyl methacrylate, hydroxyethyl methacrylate, butyl methacrylate, ethyl acrylate, hydroxyethyl acrylate, butyl acrylate and 2-ethylhexyl acrylate, optionally together with one or more other polymerizable ethylenically unsaturated monomers including vinyl aromatic compounds such as styrene and vinyl toluene, nitriles such as acrylontrile and methacrylonitrile, vinyl and vinylidene halides, and vinyl esters such as vinyl acetate. Other suitable acrylics and methods for preparing the same are disclosed in U.S. Pat. No. 5,196,485 at column 11, lines 16–60, which are incorporated herein by reference.

Polyesters and alkyds are other examples of resinous binders useful for preparing the basecoating composition. Such polymers can be prepared in a known manner by condensation of polyhydric alcohols, such as ethylene glycol, propylene glycol, butylene glycol, 1,6-hexylene glycol, neopentyl glycol, trimethylolpropane and pentaerythritol, with polycarboxylic acids such as adipic acid, maleic acid, fumaric acid, phthalic acids, trimellitic acid or drying oil fatty acids.

Polyurethanes also can be used as the resinous binder of the basecoat. Useful polyurethanes include the reaction products of polymeric polyols such as polyester polyols or acrylic polyols with a polyisocyanate, including aromatic diisocyanates such as 4,4'-diphenylmethane diisocyanate, aliphatic diisocyanates such as 1,6-hexamethylene diisocyanate, and cycloaliphatic diisocyanates such as isophorone diisocyanate and 4,4'-methylene-bis(cyclohexyl isocyanate).

Suitable crosslinking materials include aminoplasts, polyisocyanates, polyacids, polyanhydrides and mixtures thereof. Useful aminoplast resins are based on the addition products of formaldehyde, with an amino- or amido-group carrying substance. Condensation products obtained from the reaction of alcohols and formaldehyde with melamine, urea or benzoguanamine are most common. Useful polyisocyanate crosslinking materials include those described above for the electrocoat. The amount of the crosslinking material in the basecoat coating composition generally ranges from about 5 to about 50 weight percent on a basis of total resin solids weight of the basecoat coating composition.

The liquid basecoating composition comprises one or more volatile materials such as water, organic solvents and/or amines. Nonlimiting examples of useful solvents included in the composition, in addition to any provided by other coating components, include aliphatic solvents such as hexane, naphtha, and mineral spirits; aromatic and/or alkylated aromatic solvents such as toluene, xylene, and SOLVESSO 100; alcohols such as ethyl, methyl, n-propyl, isopropyl, n-butyl, isobutyl and amyl alcohol, and m-pyrol; esters such as ethyl acetate, n-butyl acetate, isobutyl acetate and isobutyl isobutyrate; ketones such as acetone, methyl ethyl ketone, methyl isobutyl ketone, diisobutyl ketone, methyl n-amyl ketone, and isophorone, glycol ethers and glycol ether esters such as ethylene glycol monobutyl ether, diethylene glycol monobutyl ether, ethylene glycol monohexyl ether, propylene glycol monomethyl ether, propylene glycol monopropyl ether, ethylene glycol monobutyl ether acetate, propylene glycol monomethyl ether acetate, and dipropylene glycol monomethyl ether acetate. Useful amines include alkanolamines. The solids content of the liquid basecoating composition generally ranges from about 15 to about 60 weight percent, and preferably about 20 to about 50 weight percent.

The basecoating composition can further comprise one or more pigments or other additives such as UV absorbers, rheology control agents or surfactants. Useful metallic pigments include aluminum flake, bronze flakes, coated mica, nickel flakes, tin flakes, silver flakes, copper flakes and combinations thereof. Other suitable pigments include mica, iron oxides, lead oxides, carbon black, titanium dioxide and talc. The specific pigment to binder ratio can vary widely so long as it provides the requisite hiding at the desired film thickness and application solids.

Suitable waterborne basecoats for color-plus-clear composites include those disclosed in U.S. Pat. Nos. 4,403,003; 5,401,790 and 5,071,904, which are incorporated by reference herein. Also, waterborne polyurethanes such as those prepared in accordance with U.S. Pat. No. 4,147,679 can be used as the resinous film former in the basecoat, which is incorporated by reference herein. Suitable film formers for organic solvent-based base coats are disclosed in U.S. Pat. No. 4,220,679 at column 2, line 24 through column 4, line 40 and U.S. Pat. No. 5,196,485 at column 11, line 7 through column 13, line 22, which are incorporated by reference herein.

The thickness of the basecoating composition applied to the substrate can vary based upon such factors as the type of substrate and intended use of the substrate, i.e., the environment in which the substrate is to be placed and the nature of the contacting materials. Generally, the thickness of the basecoating composition applied to the substrate ranges from about 10 to about 38 micrometers, and more preferably about 12 to about 30 micrometers.

The basecoat can be dried by conventional hot air convection drying or infrared drying, but preferably is dried by exposing the basecoat to low velocity air to volatilize at least a portion of the volatile material from the liquid basecoating composition and set the basecoating composition. The basecoating composition can be exposed to air having a temperature ranging from about 10° C. to about 50° C. for a period of at least about 5 minutes to volatilize at least a portion of volatile material from the liquid basecoating composition, the velocity of the air at a surface of the basecoating composition being less than about 0.5 meters per second, using apparatus similar to step 112 above. Infrared radiation and hot air can be applied simultaneously to the basecoating composition for a period of at least about 2 minutes, to increase the temperature of the metal substrate at a rate ranging from about 0.4° C. per second to about 1.1° C. per second to achieve a peak metal temperature of the substrate ranging from about 120° C. to about 165° C., such that a dried basecoat is formed upon the surface of the metal substrate, similar to step 116 above. The velocity of the air at the surface of the basecoating composition is preferably less than about 4 meters per second during this drying step.

The dried basecoat that is formed upon the surface of the automobile body 16 is dried sufficiently to enable application of a topcoat such that the quality of the topcoat will not be affected adversely by further drying of the basecoat. Preferably, the dried basecoat is cured prior to application of the topcoat. To cure the dried basecoat, the process of the present invention can further comprise an additional curing step in which hot air is applied to the dried basecoat for a period of at least about 6 minutes to hold a peak metal temperature ranging from about 110° C. to about 135° C. Preferably, a combination of hot air convection drying and infrared radiation is used simultaneously to cure the dried basecoat. As used herein, "cure" means that any crosslinkable components of the dried basecoat are substantially crosslinked.

This curing step can be carried out using a hot air convection dryer, such as are discussed above or in a similar manner to that of step 120 above using a combination infrared radiation/convection drying apparatus, however the peak metal temperature of the substrate ranges from about 110° C. to about 135° C. and the substrate is maintained at the peak metal temperature for at least about 6 minutes, and preferably about 6 to about 20 minutes.

The hot drying air preferably has a temperature ranging from about 110° C. to about 150° C., and more preferably about 120° C. to about 140° C. The velocity of the air at the surface of the basecoating composition in the curing step can range from about 4 to about 20 meters per second, and preferably ranges from about 10 to about 20 meters per second.

If a combination of hot air and infrared radiation is used, the infrared radiation applied preferably includes near-infrared region (0.7 to 1.5 micrometers) and intermediate-infrared region (1.5 to 20 micrometers), and more preferably ranges from about 0.7 to about 4 micrometers. This curing step can be carried out using any conventional combination infrared/convection drying apparatus such as the BGK combined infrared radiation and heated air convection oven which is described in detail above. The individual emitters 26 can be configured as discussed above and controlled individually or in groups by a microprocessor (not shown) to provide the desired heating and infrared energy transmission rates.

For waterborne basecoats, "dry" means the almost complete absence of water from the basecoat. If too much water is present, the topcoat can crack, bubble or "pop" during drying of the topcoat as water vapor from the basecoat attempts to pass through the topcoat.

The process of the present invention can further comprise a cooling step in which the temperature of the automobile body 16 having the dried and/or cured basecoat thereon is cooled, preferably to a temperature ranging from about 18° C. to about 32° C. and, more preferably, about 25° C. to about 30° C. Cooling the basecoated automobile body 16 can facilitate application of the topcoat by improving flow and reducing hot air eddy currents to increase transfer efficiency. The basecoated automobile body 16 can be cooled in air at a temperature ranging from about 20° C. to about 30° C., and preferably about 25° C. to about 30° C. for a period ranging from about 15 to about 30 minutes. Alternatively or additionally, the basecoated automobile body 16 can be cooled as discussed above for cooling the electrocoat.

After the basecoating on the automobile body 16 has been dried (and cured and/or cooled, if desired), a topcoating composition is applied over the dried basecoat. The topcoat can be liquid, powder or powder slurry, as desired. Preferably, the topcoating composition is a crosslinkable coating comprising at least one thermosettable film-forming material and at least one crosslinking material, although thermoplastic film-forming materials such as polyolefins can be used. The topcoating composition can include crosslinking materials and additional ingredients such as are discussed above but preferably not pigments.

Suitable waterborne topcoats are disclosed in U.S. Pat. No. 5,098,947 (incorporated by reference herein) and are based on water soluble acrylic resins. Useful solvent borne topcoats are disclosed in U.S. Pat. Nos. 5,196,485 and 5,814,410 (incorporated by reference herein) and include polyepoxides and polyacid curing agents. Suitable powder topcoats are described in U.S. Pat. No. 5,663,240 (incorporated by reference herein) and include epoxy functional acrylic copolymers and polycarboxylic acid crosslinking agents. The amount of the topcoating composition applied to the substrate can vary based upon such factors as the type of substrate and intended use of the substrate, i.e., the environment in which the substrate is to be placed and the nature of the contacting materials.

The topcoat, if in liquid form, can be dried by any conventional drying means such as hot air convection or infrared drying, such that any crosslinkable components of the liquid topcoating are crosslinked to such a degree that the automobile industry accepts the coating process as sufficiently complete to transport the coated automobile body without damage to the topcoat. Preferably, the liquid topcoating is dried in a manner similar to the basecoating using a combination infrared/hot air convection dryer as described above. After drying, the liquid topcoat is cured. Drying is not necessary for a powder topcoat, but the powder topcoat must be cured. The powder topcoat can be cured using any conventional hot air convection dryer or combination convection/infrared dryer such as are discussed above. Generally, the powder topcoat is heated to a temperature of about 140° C. to about 155° C. for a period of about 20 to about 40 minutes to cure the liquid topcoat. The thickness of the dried and crosslinked composite coating is generally about 0.2 to 5 mils (5 to 125 micrometers), and preferably about 0.4 to 3 mils (10 to 75 micrometers).

Alternatively, if the basecoat was not cured prior to applying a liquid topcoat, both the basecoat and liquid topcoating composition can be cured together by applying hot air convection and/or infrared heating using apparatus such as are described in detail above to cure both the basecoat and the liquid coating composition. To cure the basecoat and the liquid coating composition, the substrate is generally heated to a temperature of about 120° C. to about 155° C. for a period of about 20 to about 40 minutes to cure the liquid topcoat.

Advantages of the processes of the present invention include rapid coating of metal substrates and reduced processing time by eliminating or reducing the need for long assembly line ovens. The processes of the present invention can also reduce popping and increase flow and smoothness of the coating.

It will be appreciated by those skilled in the art that changes could be made to the embodiments described above without departing from the broad inventive concept thereof. It is understood, therefore, that this invention is not limited to the particular embodiments disclosed, but it is intended to cover modifications that are within the spirit and scope of the invention, as defined by the appended claims.

Therefore, I claim:

1. A process for drying a liquid electrodeposited coating composition applied to a metal substrate, comprising the successive steps of:

(a) electrophoretically depositing a liquid electrodepositable coating composition on a surface of the metal substrate to form an electrodeposited coating thereon;

(b) applying infrared radiation and warm air simultaneously to the electrodeposited coating for a period of at least about 1 minute, the velocity of the air at the surface of the electrodeposited coating being less than about 4 meters per second, the temperature of the metal substrate being increased at a rate ranging from about 0.25° C. per second to about 2° C. per second to achieve a peak metal temperature of the substrate ranging from about 35° C. to about 140° C.; and (c) applying infrared radiation and hot air simultaneously to the electrodeposited coating for a period of at least about 2 minutes, the temperature of the metal substrate being increased at a rate ranging from about 0.2° C. per second to about 1.5° C. per second to achieve a peak metal temperature ranging from about 160° C. to about 215° C., such that a dried electrodeposited coating is formed upon the surface of the metal substrate.

2. The process according to claim 1, wherein the metal substrate is selected from the group consisting of iron, steel, aluminum, zinc, magnesium and alloys and combinations thereof.

3. The process according to claim 1, wherein the metal substrate is an automotive body component.

4. The process according to claim 1, wherein the volatile material of the electrodeposited coating is selected from the group consisting of water, organic solvents and low molecular weight organic acids.

5. The process according to claim 4, wherein the volatile material of the electrodeposited coating comprises water.

6. The process according to claim 1, wherein the infrared radiation is emitted at a wavelength ranging from about 0.7 to about 20 micrometers.

7. The process according to claim 6, wherein the wavelength ranges from about 0.7 to about 4 micrometers.

8. The process according to claim 1, wherein the infrared radiation is emitted at a power density ranging from about 10 to about 40 kilowatts per square meter of emitter wall surface.

9. The process according to claim 1, wherein the air has a temperature ranging from about 35° C. to about 140° C. in step (b).

10. The process according to claim 1, wherein the period ranges from about 1 minute to about 3 minutes in step (b).

11. The process according to claim 1, wherein the air velocity ranges from about 0.5 to about 4 meters per second in step (b).

12. The process according to claim 1, wherein the temperature of the metal substrate is increased at a rate ranging from about 0.8° C. per second to about 1.2° C. per second in step (b).

13. The process according to claim 1, wherein the peak metal temperature of the metal substrate ranges from about 70° C. to about 95° C. in step (b).

14. The process according to claim 1, wherein the air has a temperature ranging from about 120° C. to about 180° C. in step (c).

15. The process according to claim 1, wherein the period ranges from about 2 minutes to about 3 minutes in step (c).

16. The process according to claim 1, wherein the temperature of the metal substrate is increased at a rate ranging from about 0.25° C. per second to about 1.1° C. per second in step (c).

17. The process according to claim 1, wherein the peak metal temperature of the metal substrate ranges from about 190° C. to about 205° C. in step (c).

18. The process according to claim 1, further comprising a preliminary step of applying the electrophoretically deposited coating by immersing the metal substrate in a bath containing a liquid electrodepositable coating composition and permitting excess liquid electrodepositable coating composition to drain from the metal substrate for at least about 5 minutes in air at a temperature ranging from about 10° C. to about 40° C. and having a velocity of less than about 0.5 meters per second.

19. The process according to claim 1, further comprising an additional step (d) of applying a second electrodepositable coating composition over the dried electrodeposited coating of step (c).

20. The process according to claim 1, further comprising an additional step (d) of applying hot air to the dried electrodeposited coating for a period of at least about 6 minutes after step (c) at a peak metal temperature ranging from about 160° C. to about 215° C., such that a cured electrodeposited coating is formed upon the surface of the metal substrate.

21. The process according to claim 20, wherein additional step (d) further comprises applying infrared radiation to the dried electrodeposited coating simultaneously while applying the hot air.

22. The process according to claim 1, further comprising an additional step (e) of applying a primer/surfacer composition over the dried electrodeposited coating.

23. The process according to claim 1, further comprising an additional step (f) of applying a basecoating composition over the dried electrodeposited coating.

24. A process for coating a metal substrate, comprising the successive steps of:

(a) electrophorectically depositing a liquid electrodepositable coating composition on a surface of the metal substrate to form a electrodeposited coating thereon;

(b) exposing the electrodeposited coating to air having a temperature ranging from about 10° C. to about 40° C. for a period of at least about 30 seconds to volatilize at least a portion of volatile material from the electrodeposited coating, the velocity of the air at a surface of the electrodeposited coating being less than about 4 meters per second;

(c) applying infrared radiation and warm air simultaneously to the electrodeposited coating for a period of at least about 1 minute, the velocity of the air at the surface of the electrodeposited coating being less than about 4 meters per second, the temperature of the metal substrate being increased at a rate ranging from about 0.25° C. per second to about 2° C. per second to achieve a peak metal temperature of the substrate ranging from about 35° C. to about 140° C.; and (d) applying infrared radiation and hot air simultaneously to the electrodeposited coating for a period of at least about 2 minutes, the temperature of the metal substrate being increased at a rate ranging from about 0.2° C. per second to about 1.5° C. per second to achieve a peak metal temperature ranging from about 160° C. to about 215° C., such that a dried electrodeposited coating is formed upon the surface of the metal substrate.

* * * * *